US007544106B2

(12) United States Patent
Muneyasu

(10) Patent No.: US 7,544,106 B2
(45) Date of Patent: Jun. 9, 2009

(54) TERMINAL FITTING

(75) Inventor: Kazuhide Muneyasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/930,375

(22) Filed: Oct. 31, 2007

(65) Prior Publication Data

US 2008/0102717 A1 May 1, 2008

(51) Int. Cl.
*H01R 11/22* (2006.01)

(52) U.S. Cl. ..... 439/852

(58) Field of Classification Search ..... 439/852, 439/853, 854
See application file for complete search history.

(56) References Cited

U.S. PATENT DOCUMENTS 3,992,076 A * 11/1976 Gluntz ..... 439/853
5,630,738 A 5/1997 Ito et al.
6,116,970 A 9/2000 Yamamoto et al.
6,547,608 B2 * 4/2003 Sato et al. ..... 439/852
2002/0155763 A1 10/2002 Saitoh
2005/0245130 A1 11/2005 Shiga et al.
2006/0003641 A1 1/2006 Morikawa
2006/0009090 A1 1/2006 Noro et al.

FOREIGN PATENT DOCUMENTS

JP 2005-044598 2/2005

* cited by examiner

*Primary Examiner*—Gary F. Paumen
(74) *Attorney, Agent, or Firm*—Gerald E. Hespos; Anthony J. Casella

(57) ABSTRACT

A female terminal fitting (10) is provided with a box-shaped main portion (11) into which a mating tab (61) is insertable, and a resilient touching piece (12) having a projection as a contact projection (32) that can contact the tab (61) is provided in the main portion (11). The tab is formed by folding the opposite widthwise sides of a metal plate in a thickness direction and causing the end edges of the folded parts to face each other. A flat surface (35) of the contact projection (32) comes into flat contact with the tab (61) while crossing over the facing ends (64) when the tab (61) is inserted properly into the main portion (11). Accordingly, edges (67) of the facing ends (64) do not sharply act on the contact projection (32).

9 Claims, 5 Drawing Sheets

TERMINAL FITTING

BACKGROUND OF THE INVENTION

1. Field of the Invention

The invention relates to a terminal fitting and to a connecting method therefor.

2. Description of the Related Art

Japanese Unexamined Patent Publication No. 2005-44598 and FIG. 5 herein disclose a female terminal fitting 4 with a box-shaped main portion 3 configured for receiving a mating tab 2. A resilient touching piece 5 is formed in the main portion 3. A contact projects from the upper surface of the resilient touching piece 5 and has a curved projecting piece. An elongated receiving portion 7 projects at a position on the inner surface of the main portion 3 facing the contact 6. The tab 2 has a double-plate structure by folding opposite widthwise ends of a metal plate in the thickness direction and causing the end edges of the folded parts to face each other. The tab 2 is inserted into the main portion 3 from the front so that the facing ends 8 face towards the contact 6. The resilient touching piece 5 is deformed resiliently by the tab 2 and the tab 2 is supported while being squeezed resiliently between the contact 6 and the receiving portion 7 to connect the two terminal fittings electrically.

The contact 6 establishes a connection with the tab 2 by a point contact of the projecting curved surface of the contact 6 with edges 9 of the facing ends 8 of the tab 2 when the tab 2 is inserted properly into the main portion 3. However, the contact 6 might be streaked by the edges 9 to impair contact stability, for example, when the tab 2 moves loosely in the main portion 3 due to vibration.

The invention was developed in view of the above situation, and an object thereof is to ensure contact stability with a tab.

SUMMARY OF THE INVENTION

The invention relates to a terminal fitting, comprising a main portion into which a mating tab is insertable. A touching piece is provided at the main portion and has a projecting contact that can contact the tab. The contact has at least one flat surface that can be brought into flat contact (i.e. a contact other than a point contact, such as a line contact or a surface contact) with the tab when the tab is inserted properly into the main portion. Thus, the contact will not be streaked by the tab even if the tab moves loosely in the main portion due to vibration. As a result, contact stability can be improved.

The main portion of the terminal fitting preferably is substantially box-shaped.

The tab preferably is formed by folding opposite widthwise end portions of a metal plate in a thickness direction and causing the end edges of the folded parts to face each other. The tab then may be inserted into the main portion with the facing ends faced toward the contact. As a result, the contact comes into flat contact with the tab while crossing over the facing ends when the tab is inserted properly into the main portion.

The contact preferably is disposed to be held in contact with a widthwise substantially central part of the tab.

At least two receiving portions preferably are provided for supporting the tab. For example, the receiving portions may be at opposite widthwise sides of the tab and project from an inner surface of the main portion facing the contact with the tab held between the contact and the receiving portions.

The tab contacts the widthwise central part of the contact and may vibrate about a longitudinal axis at the contact due to vibration. However, the receiving portions support the opposite widthwise sides of the tab on a surface of the tab opposite the contact. Thus, vibration about the longitudinal axis is prevented and the contact and the tab are held in flat contact.

A connection area of the contact with the tab and connection areas of the receiving portions with the tab are arranged substantially symmetrically with respect to the widthwise central axis of the tab, at least when the terminal fitting is connected properly with the tab.

The flat surface of the contact preferably is formed to be gradually wider from a starting end with respect to the insertion direction of the tab to a rear end with respect to the insertion direction of the tab. Thus, insertion resistance at the initial stage of the insertion of the tab can be reduced to improve operability, whereas the flat surface can be held stably in contact with the tab after the completion of the insertion of the tab.

The main portion preferably has at least one projecting piece projecting substantially inwardly, and an excessive resilient deformation of the resilient touching piece can be prevented by contact with the projecting piece.

The contact preferably has a fan-shaped portion gradually widened backward and a curve defining the rear edge of the contact. The fan-shaped portion and the curve are connected unitarily one after the other.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
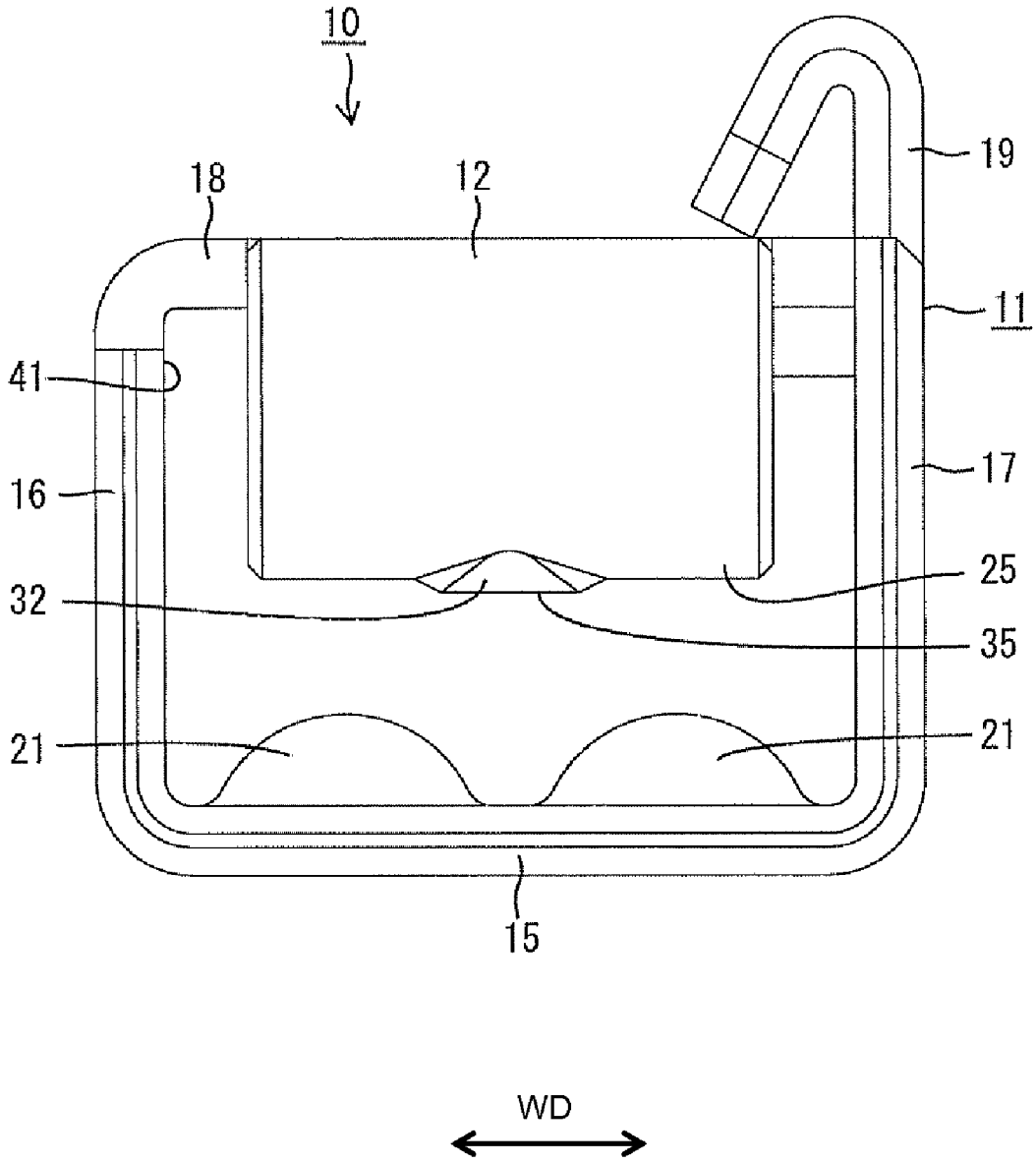
FIG. 1 is a front view of a female terminal fitting according to the invention.
Figure 2:
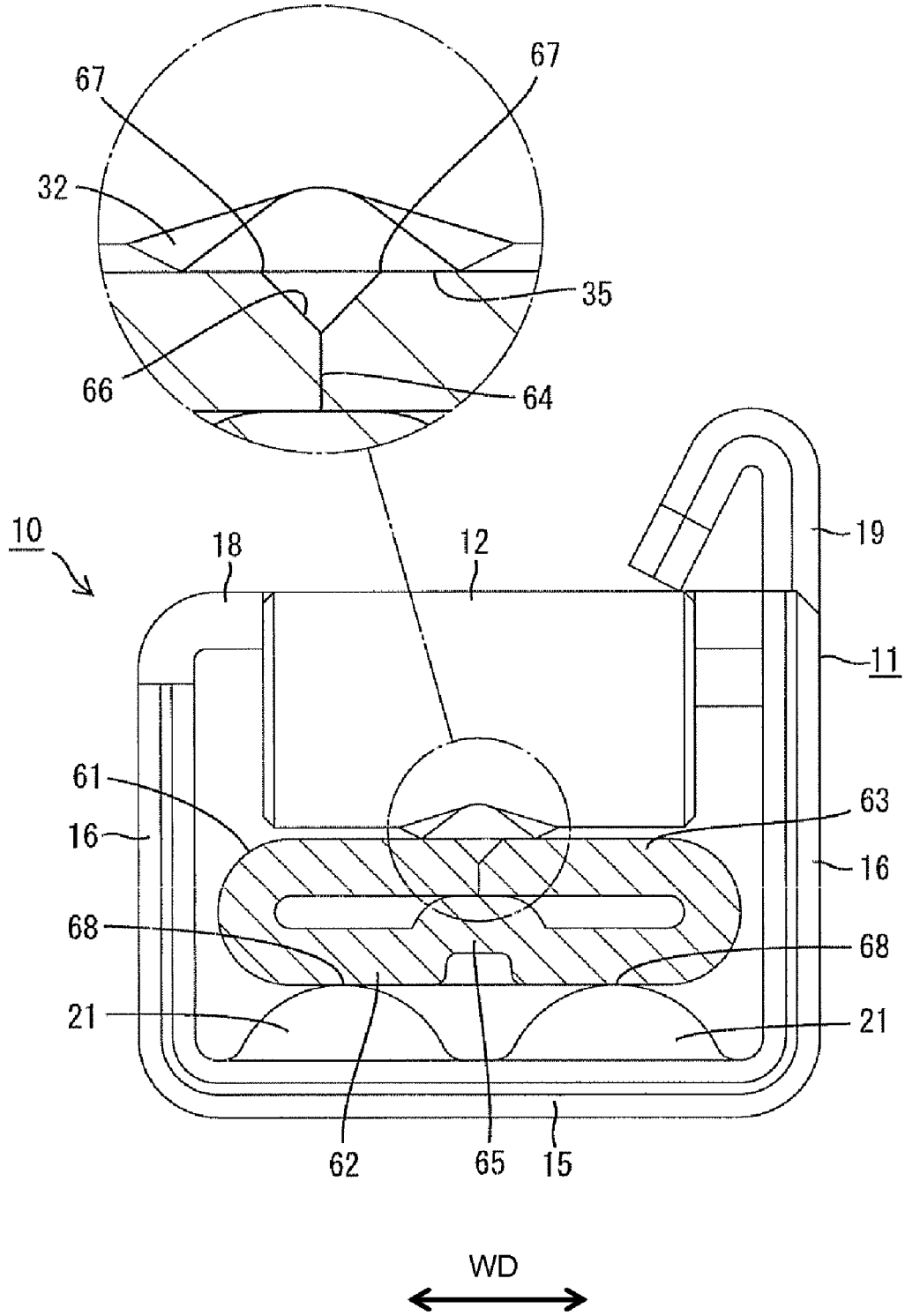
FIG. 2 is a front view of the female terminal fitting properly connected with a tab.

A female terminal fitting in accordance with the invention is identified by the numeral 10 in FIGS. 1 through 4. The female terminal fitting 10 can mate with a male terminal fitting 60 formed by bending an electrically conductive metal plate. Although not shown entirely, a tab 61 is formed at the leading end of the male terminal fitting 60 and extends in forward and backward directions FBD. The tab 61 is formed by folding the opposite left and right edge portions of the conductive metal plate in a thickness direction and causing the side edges of the folded parts to be in face to face contact with each other. Thus, the tab 61 includes a base wall 62 and left and right covering walls 63 folded on the base wall 62. Facing ends 64 of the covering walls 63 are arranged substantially in the widthwise center of the tab 61. A supporting mount 65 is embossed to project from the base wall 62 towards the facing ends 64. A clearance corresponding to a projecting amount of the supporting mount 65 is defined between the base wall 62 and the covering walls 63. Upper parts of the facing ends 64 are formed into slanted surfaces 66, the spacing of which is widened outwardly, and obtuse-angled edges 67 are formed at corners where the slanted surfaces 66 and the upper surfaces of the covering walls 63 meet.

Figure 3:
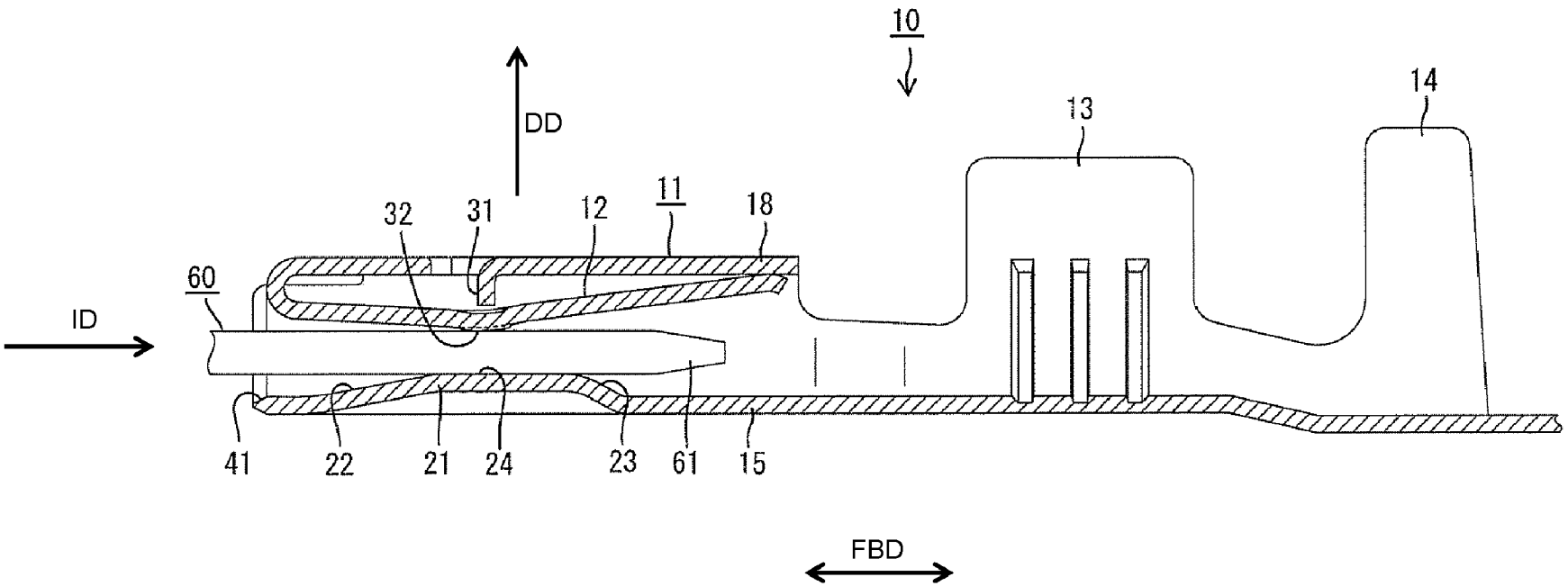
FIG. 3 is a side view in section of the female terminal fitting properly connected with the tab.

The female terminal fitting 10 also is formed by bending, folding and/or embossing an electrically conductive metal plate, and has opposite front and rear ends spaced apart along forward and backward directions FBD. A rectangular tubular main portion 11 is formed adjacent the front end, a wire barrel 13 is formed rearward of the main portion 11 and an insulation barrel 14 is formed rearward of the wire barrel 13, as shown in FIG. 3. The wire barrel 13 can be crimped, bent or folded into connection with an end of a core of an unillustrated wire, and the insulation barrel 14 can be crimped, bent or folded into connection with both an end of an insulation coating of the wire and a resilient plug mounted on the wire.

The main portion 11 is long and narrow along the forward and backward directions FBD. A tab insertion opening 41 is formed at the front end of the main portion 11 and first through fourth side walls 15, 16, 17, 18 extend rearward from the front end. Specifically, the second and third side walls 16 and 17 are bent to extend perpendicularly from the opposite lateral sides of the first side wall 15. The fourth side wall 18 is bent to extend perpendicularly from the second side wall 16 to the extending end of the third side wall 17. Hence the second and third side walls 16 and 17 are opposed to each other and the first and fourth side walls 15 and 18 are opposed to each other. A stabilizer 19 projects from the area of the corner between the third and fourth side walls 17 and 18. The stabilizer 19 functions to guide an insertion of the female terminal fitting 10 into a cavity of an unillustrated connector housing and prevents an erroneous insertion of the female terminal fitting 10 into the cavity. An extending end of the stabilizer 19 is bent towards the fourth side wall to define a substantially C- or V-shaped cross section, and an unillustrated jig can be brought into contact with the front edge of the stabilizer 19 from the front to perform an electrical connection test.

The first side wall 15 is embossed inwardly to form two receiving portions 21 that project from the inner surface of the first side wall 15 towards the inside of the main portion 11. The receiving portions 21 extend in substantially forward and backward directions FBD and are spaced along the width direction WD. Thus, the receiving portions 21 are disposed near the opposite sides of the first side wall 15. Each receiving portion 21 has an arcuate cross section. A first slant portion 22 is formed on the front part of each receiving portion 21 and slopes moderately up towards the back side and a second slant portion 23 is formed on the rear part of each receiving portion and slopes more steeply down than the first slant portion 22 towards the rear. A horizontal portion 24 is arranged in an intermediate part of each receiving portion 21 between the slant portions 22, 23 and is aligned substantially horizontally along the forward and backward directions FBD.

Figure 4:
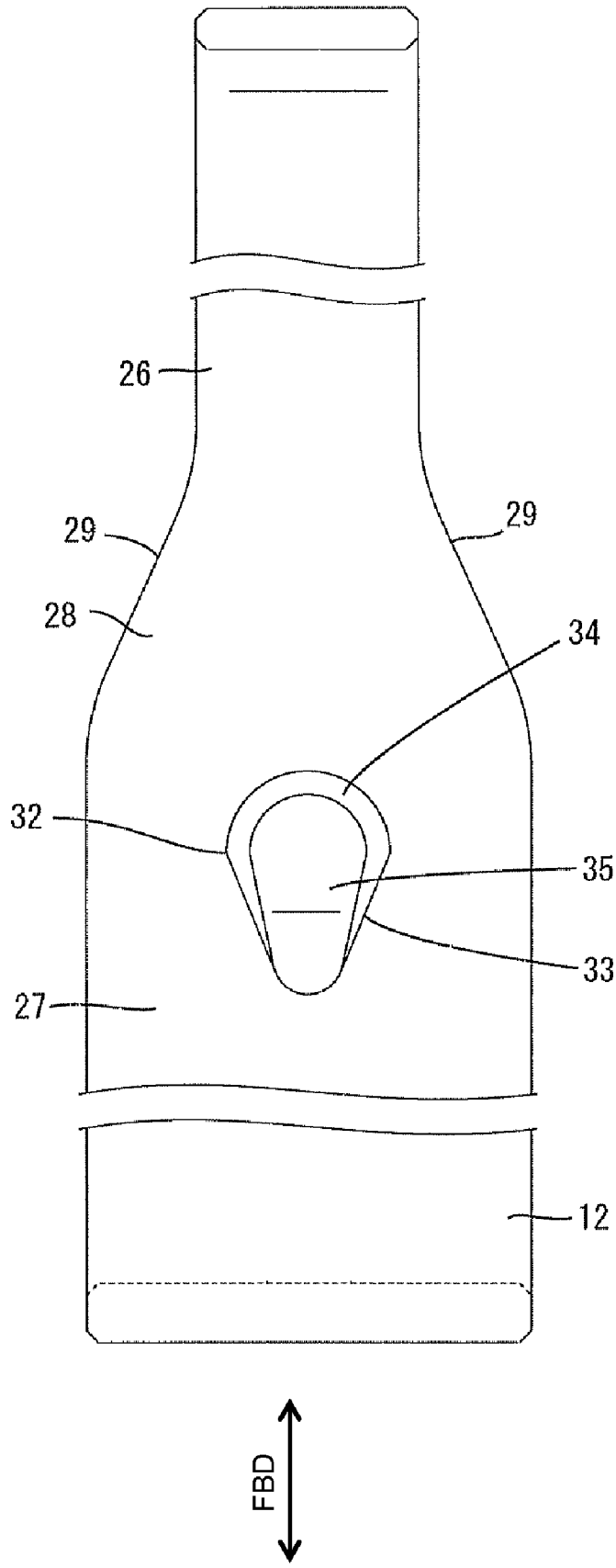
FIG. 4 is a partial enlarged plan view of a resilient touching piece.
Figure 5:
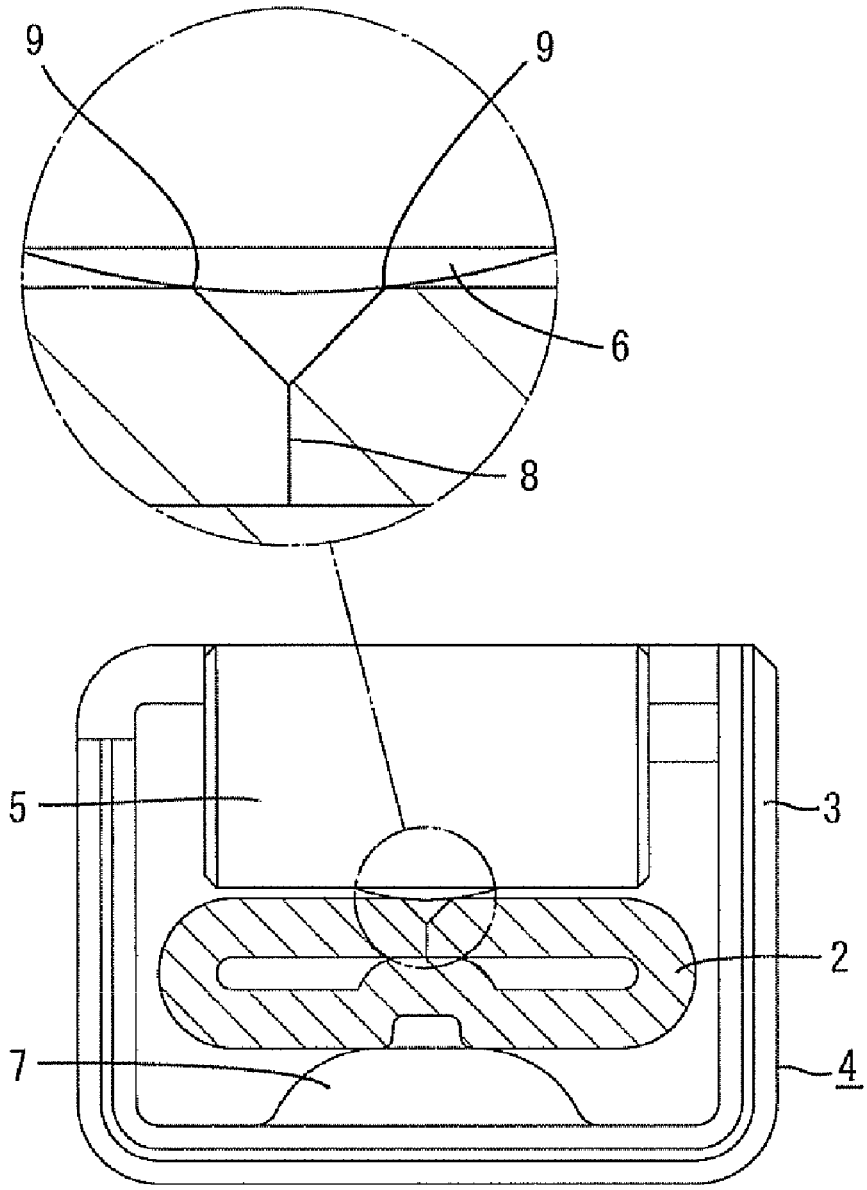
FIG. 5 PRIOR ART
FIG. 5 is a front view of a conventional female terminal fitting.

An elongated resilient touching piece 12 is connected unitarily with the front end of the fourth side wall 18, which is the wall facing the receiving portions 21. The resilient touching piece 12 is folded back from the front end of the fourth side wall 18 into the main portion 11, as shown in FIG. 3. Additionally, the resilient touching piece 12 has a substantially V-shaped cross section in side view (FIG. 3), and is resiliently deformable along a deformation direction DD that intersects the insertion direction ID of the male terminal fitting 60 into the main portion 11 while moving a tip 25 substantially up and down along the deformation direction DD as the tab 61 is inserted and withdrawn. As shown in FIG. 4, a part of the resilient touching piece 12 behind the tip 25 and towards a rear portion 26 is narrower than a part thereof before the tip 25 towards a front portion 27. An intermediate portion 28 is formed with slanted lateral edges 29, the spacing of which narrows gradually from the front portion 27 towards the rear portion 26 (see FIG. 4). As shown in FIG. 3, the fourth side wall 18 is formed with at least one projecting piece 31 that is cut and bent to project in towards the tip 25 of the resilient touching piece 12 to prevent excessive resilient deformation of the resilient touching piece 12.

A contact projection 32 is formed at the middle part of the resilient touching piece 12 in forward and backward directions FBD, and hence is near the tip 25 of the resilient touching piece 12. The contact projection 32 projects towards the receiving portions 21 and is engageable with the tab 61. Additionally, the contact projection 32 has a fan-shaped portion 33 that is widened gradually towards the rear. A curved portion 34 with a curved rear edge is formed unitarily behind the fan-shaped portion 33 (see FIG. 4). The contact projection 32 has a substantially flat lower surface 35 the receiving portions 21. The flat surface 35 is cut obliquely from the front end towards the back side, and is disposed to contact the tab 61. The flat surface 35 of the contact projection 32 is widened gradually from the front end towards the back in the fan-shaped portion 33 while being rimmed with a curved outer edge substantially parallel with the curved rear edge of the arcuate portion 34.

A distance between the flat surface 35 of the contact projection 32 and a horizontal plane connecting peaks 68 of the receiving portions 21 is smaller than the thickness of the tab 61 when the resilient touching piece 12 is in an unbiased substantially natural state. The distance between the flat surface 35 and the horizontal plane connecting peaks 68 is smaller than the smallest thickness rearward of the front taper in those situations where the tab has a variable thickness. Further, when the female and male terminal fittings 10, 60 are connected properly, a connection area of the tab 61 and the contact projection 32 and connection areas of the tab 61 and the receiving portions 21 are arranged substantially symmetrically with respect to the central axis of the tab 61.

The connection of the female and male terminal fittings 10, 60 accommodated in the two connector housings is started as unillustrated female and male housings are connected. The tab 61 is inserted through the tab insertion opening 41 and into the main portion 11 substantially in the inserting direction ID at an initial stage of the connection of the two housings. At this time, the facing ends 64 of the tab 61 face towards the resilient touching piece 12 for various reasons. During the insertion, the tab 61 contacts the flat surface 35 of the contact projection 32 while being held in sliding contact with the peaks 68 of the receiving portions 21. Additionally, the resilient touching piece 12 is deformed resiliently in the deformation direction DD and towards the fourth side wall 18. As the connection of the two housings proceeds, the resilient touching piece 12 deforms more while the tab 61 is held in sliding contact with the flat surface 35 of the contact projection 32. The insertion resistance of the tab 61 at the initial stage of the connection is low because the flat surface 35 of the contact projection 32 becomes gradually wider as the insertion depth of the tab 61 increases along the inserting direction ID.

In the process of connecting the housings and after the completion of the connection of the housings, the widthwise center of one surface of the tab 61 is held resiliently in contact with the contact projection 32, while the widthwise side regions of the opposite surface of the tab 61 is supported in contact by the receiving portions 21 at positions laterally outward from the supporting mount 65 of the tab 61. The flat surface 35 of the contact projection 32 is maintained in substantially flat contact with the tab 61, as opposed to a point contact, while crossing over the facing ends 64 of the tab 61. Specifically, the flat surface 35 of the contact 32 extends substantially continuously at the same height in the width direction WD and is held in substantially line contact (i.e. contact with at least one substantially linear extension) with the upper surfaces of the covering walls 63 of the tab 61. The covering walls 63 are substantially coplanar at opposite sides of the facing ends 64 in width direction WD without the action of the edges 67 of the facing ends 64. Further, the contact projection 32 stably contacts the tab 61 at the wide part of the fan-shaped portion 33 at the final stage of the insertion of the tab 61.

As described above, the contact projection 32 of the resilient touching piece 12 is held in flat contact with the tab 61 while crossing over the facing ends 64 of the tab 61. Thus, even if the tab 61 moves loosely in the main portion 11 the contact projection 32, e.g. due to vibration, can be prevented from being streaked or scratched by the edges 67 of the facing ends 64. As a result, contact stability is improved.

Further, the tab 61 is held in contact with the contact projection 32 substantially at the widthwise center, and might vibrate or rotate about its longitudinal axis at the contact projection 32. However, the tab 61 is supported in contact by the two receiving portions 21 at the opposite widthwise sides at the surface opposite to the contact projection 32. Thus, vibration about the longitudinal axis and the like can be prevented and the contact projection 32 and the tab 61 can be held reliably in flat contact.

The flat surface 35 of the contact projection 32 is gradually wider from the starting end to the rear end with respect to the insertion of the tab 61. Thus, insertion resistance at the initial stage of the insertion of the tab 61 can be reduced, whereas the flat surface 35 can be held stably in contact with the tab 61 after the completion of the insertion of the tab 61.

The invention is not limited to the above described and illustrated embodiment. For example, the following embodiments are also embraced by the technical scope of the present invention as defined by the claims.

According to the present invention, only one receiving portion or three or more thereof may be provided on the inner surface of the main portion facing the contact portion.

According to the present invention, the flat surface of the contact portion may extend over at least part or over the substantially entire length in forward and backward directions FBD preferably while having the substantially same width.

According to the present invention, the facing ends of the tab may be located at a position deviated from the widthwise center of the tab.

According to the present invention, the resilient touching piece may be in the form of a beam having both ends supported on the main portion.

What is claimed is:

1. A terminal fitting, comprising:

a substantially tubular main portion having opposite front and rear ends spaced apart along a longitudinal direction, the front end of the main portion being open for receiving a mating tab; and a resiliently deformable touching piece folded back from the front end of the main portion and into the main portion, a contact projection projecting from the touching piece for contacting the tab, the contact projection having at least one flat surface disposed and aligned for achieving flat contact with the tab in a direction substantially normal to the longitudinal direction of the main portion while crossing over facing ends of folded parts of the tab when the tab is inserted properly into the main portion.

2. The terminal fitting of claim 1, wherein the contact projection is disposed for contacting a widthwise substantially central part of the tab.

3. The terminal fitting of claim 1, wherein at least two receiving portions project from an inner surface of the main portion facing the contact projection for supporting laterally spaced positions of the tab and at a side of the tab opposite the contact projection.

4. The terminal fitting of claim 1, wherein the main portion is formed with at least one projecting piece projecting substantially inwardly, and an excessive resilient deformation of the resilient touching piece can be prevented by coming into contact with this projecting piece.

5. A terminal fitting, comprising:

a main portion for receiving a mating tab;

a touching piece in the main portion and having a contact projection for contacting the tab, the contact projection having at least one flat surface disposed and aligned for achieving flat contact with the tab while crossing over facing ends of folded parts of the tab when the tab is inserted properly into the main portion; and at least two receiving portions projecting from an inner surface of the main portion facing the contact projection for supporting laterally spaced positions of the tab and at a side of the tab opposite the contact projection, wherein a connection area of the contact projection with the tab and connection areas of the receiving portions with the tab are substantially symmetrically arranged with respect to a widthwise central axis of the tab when the terminal fitting is connected properly with the tab.

6. A terminal fitting, comprising:

a main portion for receiving a mating tab;

a touching piece in the main portion and having a contact projection for contacting the tab, the contact projection having at least one flat surface disposed and aligned for achieving flat contact with the tab while crossing over facing ends of folded parts of the tab when the tab is inserted properly into the main portion, wherein the flat surface of the contact projection is formed to be gradually wider from a starting end with respect to an insertion direction of the tab to a rear end with respect to the insertion direction of the tab.

7. A terminal fitting, comprising:

a main portion for receiving a mating tab;

a touching piece in the main portion and having a contact projection for contacting the tab, the contact projection having at least one flat surface disposed and aligned for achieving flat contact with the tab while crossing over facing ends of folded parts of the tab when the tab is inserted properly into the main portion, wherein the contact projection comprises a fan-shaped portion gradually widened backward and a curved portion defining an curved rear edge of the contact projection, wherein the fan-shaped portion and the curved portion are connected unitarily one after the other.

8. A terminal fitting assembly, comprising:

a male terminal fitting having a tab, the tab having folded parts with facing end edges; and a female terminal fitting having a tubular main portion for receiving the tab, a touching piece in the main portion and having a contact projection with at least one flat surface disposed and aligned for achieving flat contact with the tab while crossing over facing ends of folded parts of the tab when the tab is inserted properly into the main portion, at least two receiving portions projecting from an inner surface of the main portion facing the contact projection for supporting laterally spaced positions of the tab and at a side of the tab opposite the contact projection, a connecting area of the contact projection with the tab and connection areas of the receiving portions with the tab being substantially symmetrically arranged with respect to a widthwise central axis of the tab when the terminal fitting is connected properly with the tab.

9. The terminal fitting assembly of claim 8, wherein the contact projection is disposed for contacting a widthwise substantially central part of the tab.

* * * * *

UNITED STATES PATENT AND TRADEMARK OFFICE

CERTIFICATE OF CORRECTION

PATENT NO. : 7,544,106 B2
APPLICATION NO. : 11/930375
DATED : June 9, 2009
INVENTOR(S) : Kazuhide Muneyasu It is certified that error appears in the above-identified patent and that said Letters Patent is hereby corrected as shown below:

Title Page, Insert:

--(30) Foreign Application Priority Data

Oct. 19, 2006 (JP) ..... 2006-297444--

Signed and Sealed this

Twenty-eighth Day of July, 2009

John Doll

JOHN DOLL
*Acting Director of the United States Patent and Trademark Office*